US008381459B2

(12) United States Patent
Ramsay et al.

(10) Patent No.: US 8,381,459 B2
(45) Date of Patent: Feb. 26, 2013

(54) ADJUSTABLE ROOF VENTILATOR BASE

(76) Inventors: Serge Ramsay, Montreal (CA); Linda Ramsay, Montreal (CA)

( * ) Notice: Subject to any disclaimer, the term of this patent is extended or adjusted under 35 U.S.C. 154(b) by 0 days.

(21) Appl. No.: 13/140,780

(22) PCT Filed: Dec. 19, 2008

(86) PCT No.: PCT/CA2008/002251

§ 371 (c)(1),
(2), (4) Date: Sep. 2, 2011

(87) PCT Pub. No.: WO2010/069037

PCT Pub. Date: Jun. 24, 2010

(65) Prior Publication Data

US 2011/0302864 A1 Dec. 15, 2011

(51) Int. Cl.
*F24F 7/02* (2006.01)
*E04B 7/18* (2006.01)

(52) U.S. Cl. ..... 52/98; 52/72; 52/198; 52/199; 52/105; 52/200; 454/364; 454/365

(58) Field of Classification Search ..... 52/72, 98, 52/198, 199, 200; 454/364–366
See application file for complete search history.

(56) References Cited

U.S. PATENT DOCUMENTS

| | | | | |
|---|---|---|---|---|
| 1,322,711 | A * | 11/1919 | Maranville | 454/363 |
| 2,868,106 | A | 1/1959 | Knutson et al. | |
| 3,209,669 | A | 10/1965 | Bayne | |
| 3,216,161 | A * | 11/1965 | Forsman | 52/200 |
| 3,338,006 | A * | 8/1967 | Belden | 52/200 |
| 4,850,265 | A | 7/1989 | Raisanen | |
| 4,888,923 | A * | 12/1989 | Post, Jr. | 52/200 |

(Continued)

FOREIGN PATENT DOCUMENTS

| | | |
|---|---|---|
| CA | 1181281 A | 1/1985 |
| CA | 2167041 A1 | 7/1997 |
| CA | 2571969 A1 | 6/2007 |

OTHER PUBLICATIONS

PCT/CA2008/002251—International Search Report dated Aug. 26, 2009.
PCT/CA2008/002251—International Preliminary Report on Patentability dated Aug. 26, 2009.
PCT/CA2006/001883—International Search Report dated Aug. 16, 2007.

(Continued)

*Primary Examiner* — Robert Canfield
(74) *Attorney, Agent, or Firm* — Wolf, Greenfield & Sacks, P.C.

(57) ABSTRACT

A roof ventilator mount for mounting a roof ventilator onto a gable-type roof (21), the roof ventilator including a roof ventilator base (10) defining a cupola mounting portion (25) for mounting a cupola (12) thereto, the roof ventilator mount comprising: a first mounting component (26), the first mounting component (26) including a first mounting plate (48) mountable to the roof (21); a second mounting component (26), the second mounting component (26) including a second mounting plate (48) mountable to the roof (21); the first and second mounting components (26) being mountable to the roof ventilator base (10) with proximal edges (47) thereof located substantially adjacent to each other and distal edges (49) thereof located spaced apart from each other; the first and second mounting plates (48) being each provided with a breakable segment (66) extending from the proximal edge (47), the breakable segment (66) being breakable from the remainder of the mounting plate (48) along a predetermined break line located at a predetermined distance from the distal edge (49).

20 Claims, 13 Drawing Sheets

U.S. PATENT DOCUMENTS

| | | | | |
|---|---|---|---|---|
| 5,655,964 | A | 8/1997 | Rheault | |
| 6,422,936 | B1 * | 7/2002 | Van Gilst et al. | 454/367 |
| 6,932,690 | B2 * | 8/2005 | Ramsay | 454/66 |
| 2006/0035583 | A1 * | 2/2006 | Farr et al. | 454/365 |
| 2010/0255769 | A1 * | 10/2010 | Farr | 454/365 |

OTHER PUBLICATIONS

PCT/CA2006/001883—International Preliminary Report on Patentability dated Aug. 16, 2007.

* cited by examiner

ADJUSTABLE ROOF VENTILATOR BASE

FIELD OF THE INVENTION

The present invention relates to the general field of roof ventilators, and is particularly concerned with an adjustable roof ventilator base for allowing the roof ventilator to be mounted over the ridge of a gable roof.

BACKGROUND

Energy-efficiency is a serious consideration in building design and construction. Many building codes require builders to minimize energy requirements to maintain comfortable living spaces.

One of the most common energy loss in a building is due to the heat transfer through the attic. In warm climates, heat builds up in the attic from solar energy incident on the roof or from heat transferred up from the living space. If the attic is allowed to become too warm, the installed insulation becomes ineffective and the attic heat is transferred to the living space below.

In colder climates, moisture builds up in the attic, sometimes significantly decreasing the efficiency of the insulation. The moisture, regardless of its numerous potential origins, left unchecked will build up and potentially cause extensive damage within the structure. Moisture originating from the shower, kitchen steam or the like not only potentially decreases the insulating value of insulation, but also potentially leads to mould and mildew growth.

Hence, it is well known in the home building industry that proper circulation of air within the attic zone and above the level at which the insulation is installed is essential to avoid moisture build-up during cold winter months and to maintain the un-insulated attic space at a reasonably low temperature during warm summer months. Early efforts at minimizing energy losses through the attic focused on the insulation between the living space and the attic and ignored the effects of the heat and/or moisture build-up. As insulation improved, a point was reached where more insulation was not necessarily better or possible due to space limitations.

Numerous attempts have been made to alleviate this problem by installing vents at various points in the roofing structure. One common technique is to include vents or venting apertures on the underside of the soffite of the roof as, for example, on the underside of the eaves. While this practice allows some of the heat to escape, the ventilation provided remains poor. Indeed, because the vents are located on the underside of the eaves, the heat must build up to relatively high levels before it is forced downwardly out of the vents due to the fact that heat naturally rises. This also causes non-uniform heat distribution within the attic or roof structure.

Since the heat rises, the temperature closest to the roof will consistently remain at temperatures higher that that of the areas further away from the roof and near the eaves. Also, in sloped roof structures, the heat will concentrate adjacent the apex creating higher temperatures of the apex, which steadily decrease along the roof line toward the eaves. Hence, the air allowed to escape at the eaves is not the hottest air.

Other attempts have been made to increase ventilation. In one common technique, a venting aperture is cut in various parts of the roof and then covered with a box-like ventilation duct. Static roof ventilators also commonly referred to as "pot vents" typically include three main components. Conventional pot vents typically include a flange or base portion, a conduit or duct portion and a hood or cover portion.

The flange is nailed or otherwise secured to the roof deck over a similarly sized aperture as with the conduit portion. Typically, the leading edge of the flange is positioned over a course of shingles, while additional courses are laid over the flange and cut to fit around the conduit. The hood portion, which is rigidly attached to the flange, prevents moisture penetration in most cases.

Turbine-type roof ventilators are also sometimes used. These turbine roof ventilators typically include a sleeve on the top end of which is mounted a rotatable turbine fluid. Typically, the turbine fluid includes a closed circular, usually convex upper end which prevents ingress of rain into the sleeve and thus into the roof chamber, a lower ring and a series of arcuate turbine blades extending from the lower ring to the upper end through which hot air flows. The turbine blades are rotatable either due to winds or breezes or to the flow of air from out under the roof through the turbine.

Whether of the turbine or static type, most roof ventilators are typically constructed for a given predetermined roof slope or pitch. So-called roof jacks are sometimes provided to connect the outlet of the roof-mounted air handler such as a ventilator to an air duct which emerges from the roof. Prior art roof jacks are typically constructed to couple the typically horizontally oriented aperture at the bottom of the ventilator to the slope or pitch of the roof. Generally each roof jack must be specifically constructed to fit the slope or pitch of the roof upon which it is to be used.

Accordingly, roof jack suppliers are required to maintain a relatively large inventory of roof jacks in order to accommodate the full range of slopes or pitch which are encountered in the building industry. Roof jacks suppliers must also stock roof jacks having different sizes in terms of cross-section in order to meet the needs of various duct and exhaust outlet sizes which are encountered in roof-mounted ventilators.

Consequently, roof jack suppliers are faced with the problem of high costs and high storage space if they want to be able to supply roof jacks accommodating the full range of slopes and cross-sectional diameters encountered in the industry.

Even in cases wherein a given stock roof jack is available and used for a given roof pitch or slope, the slope of the roof may be slightly deviant from the design value and the stock roof jack may not fit the angle perfectly. In such cases, the misfit may cause air leakage from the system or may cause the ventilator to be mounted at a slight angle which could, in turn, cause problems in operation of the ventilator.

Also, the configuration of some prior art adjustable roof jacks sometimes leads to losses or reductions in terms of effective cross-sectional area through which the air may flow when the roof jack is bent so as to provide for angle adjustability. The configuration of some prior art adjustable roof jacks sometimes unduly restricts the flow of air and/or creates air leaks.

Another main disadvantage associated with prior art structures is that they are typically not adapted to be used with so-called gable roofs.

Against this background, there exist a need for a new and improved staple remover that avoids the aforementioned disadvantages. It is a general object of the present invention to provide a new and improved staple remover.

SUMMARY OF THE INVENTION

A roof ventilator mount for mounting a roof ventilator onto a gable-type roof, the gable-type roof defining a roof first section and a roof second section, the roof first and second sections merging together about a roof apex, the roof ventilator including a roof ventilator base defining a cupola mounting portion for mounting a cupola thereto, the roof ventilator mount comprising:

a first mounting component, the first mounting component including a first mounting plate mountable to the roof first section, the first mounting plate defining a first plate proximal edge and a substantially opposed first plate distal edge, the first mounting plate also defining a first plate proximal section extending from the first plate proximal edge and a first plate distal section extending from the first plate distal edge;

a second mounting component, the second mounting component including a second mounting plate mountable to the roof second section, the second mounting plate defining a second plate proximal edge and a substantially opposed second plate distal edge, the second mounting plate also defining a second plate proximal section extending from the second plate proximal edge and a second plate distal section extending from the second plate distal edge;

the first and second mounting components being mountable to the roof ventilator base with the first and second plate proximal edges located substantially adjacent to each other and the first and second plate distal edges located spaced apart from each other;

the first plate proximal section being provided with a first plate breakable segment extending from the first plate proximal edge, the first plate breakable segment being breakable from the remainder of the first plate proximal section along a first predetermined break line located at a first predetermined distance from the first plate distal edge;

the second plate proximal section being provided with a second plate breakable segment extending from the second plate proximal edge, the second plate breakable segment being breakable from the remainder of the second plate proximal section along a second predetermined break line located at a second predetermined distance from the second plate distal edge;

whereby removing the first and second plate breakable segments respectively from the first and second plate proximal sections reduces respectively a first distance between the first plate proximal and distal edges and a second distance between the second plate proximal and distal edges to allow a variation in an angle between the first and second mounting plates when the first and second mounting plates are mounted to the roof ventilator base and the first and second plate proximal edges are abutting against each other.

Accordingly, a main advantage of the present invention resides in that the roof ventilator base is designed to fit over the ridge of a conventional gable roof with the base being adjustable so as to be readily attached to existing roofs of the gable type construction.

Other advantages of the present invention include that the proposed structure allows for the connection of a roof-mounted air handler, such as a ventilator, to an air duct extending through roofs of various slopes or pitch. The proposed structure allows for angular adjustability through a set of quick and ergonomic steps without requiring special tooling or manual dexterity.

Also, the proposed structure allows for angular adjustment thereof prior to being installed on the roof, hence reducing the overall installation time.

Still furthermore, the proposed structure allows for angular adjustability with minimal compromise of the cross-sectional effective area through which the air is guided and with minimal flow obstruction and leakage. Yet, still furthermore, the proposed structure is designed so as to reduce the risks of leakage through its sections and so as to be manufacturable through conventional forms of manufacturing using a reduced number of components, hence providing a structure that will be economically feasible, long-lasting and relatively trouble-free in operation.

Also, the use of breakable segments instead of detachable sections greatly facilitates installation of the ventilator.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
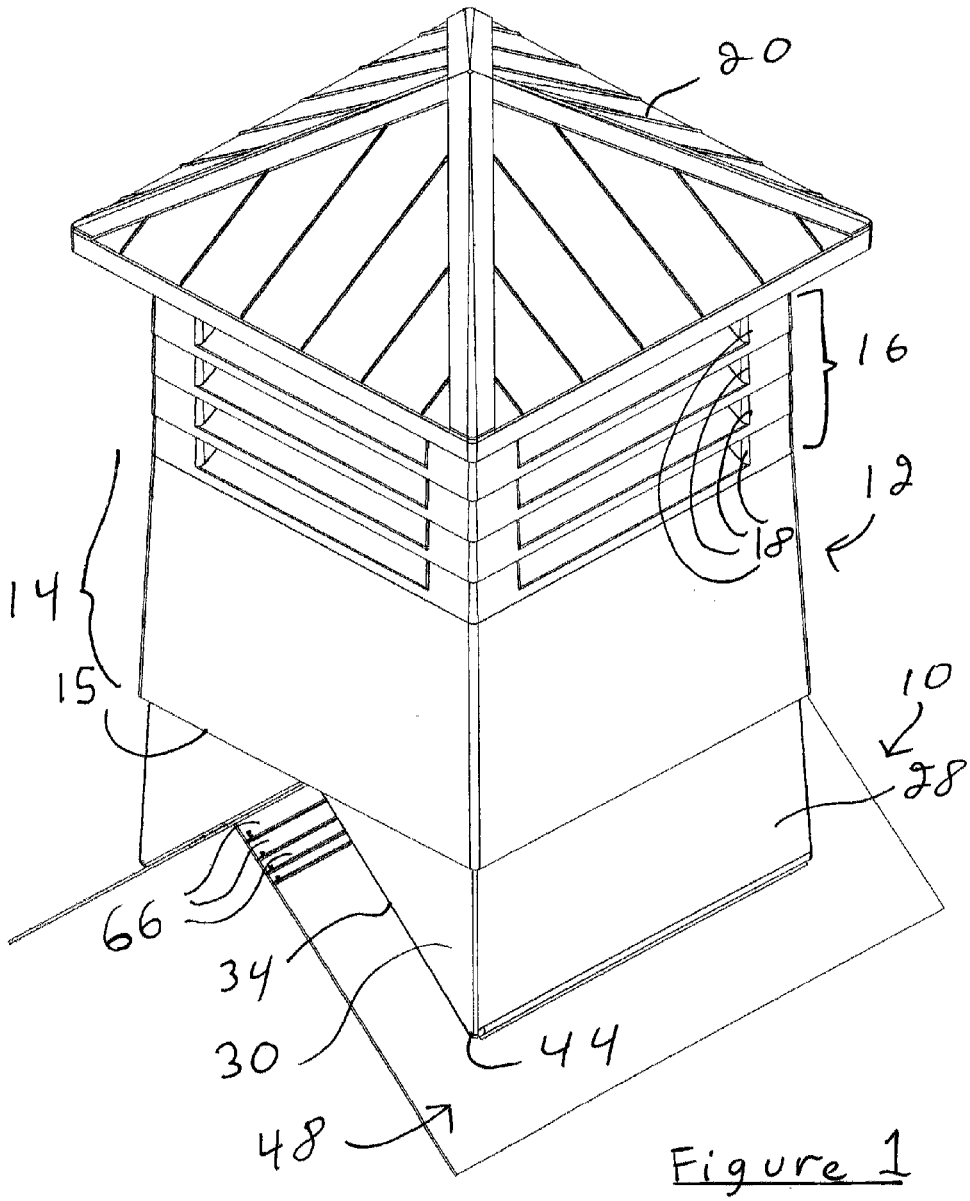
FIG. 1: in a perspective view, illustrates an adjustable roof ventilator base in accordance with an embodiment of the present invention, the base being shown with a ventilator cupola mounted thereon.

Referring to FIG. 1, there is shown an adjustable roof ventilator base in accordance with an embodiment of the present invention, generally indicated by the reference numeral 10. The roof ventilator base 10 is shown supporting a cupola 12. The cupola 12 is shown as having a cupola mounting section 14 defining a cupola lower peripheral edge 15 adapted to be abuttingly nested on the roof ventilator base 10. Typically, the cupola 12 also defines a venting section 16 provided with venting slots 18 and a cupola roof or dome 20.

It should however be understood that the roof ventilator base 10 could be used in other contexts, such as with other types of cupolas 20, other types of roof ventilator components, or the like, without departing from the scope of the present invention.

Referring now more specifically to FIGS. 9 through 13, there is shown that the roof ventilator base 10 is intended to be used on a gable-type roof 21, typically defining a pair of substantially symmetrically disposed slanted roof sections 22 merging together about a roof apex 23. It should however be understood that the roof ventilator base 10 could be used in other contexts with appropriate modifications thereto, without departing from the scope of the present invention.

Figure 9:
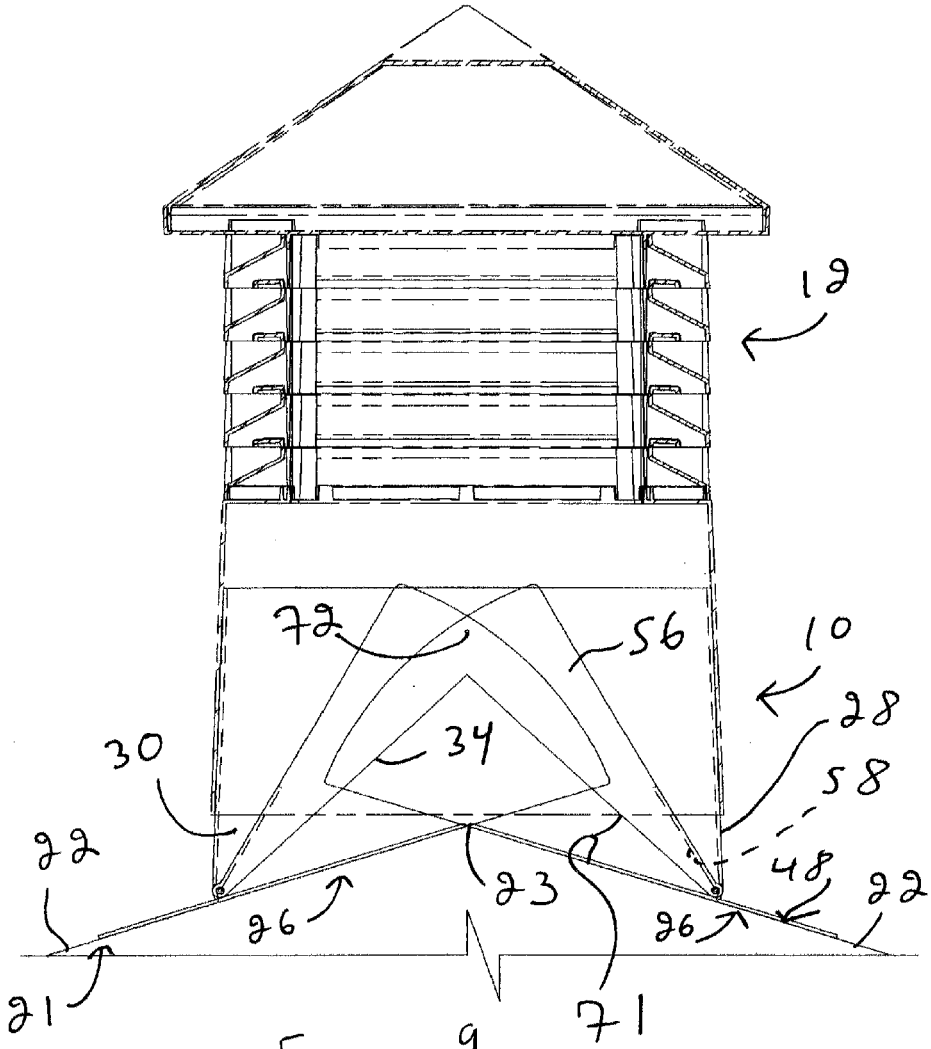
FIGS. 9, 10, 11, 12 and 13: illustrate an adjustable roof ventilator base in accordance with an embodiment of the present invention supporting a ventilator cupola and being mounted on a gable roof, the pitch of the gable roof increasing gradually from FIG. 9 to FIG. 13.
Figure 10:
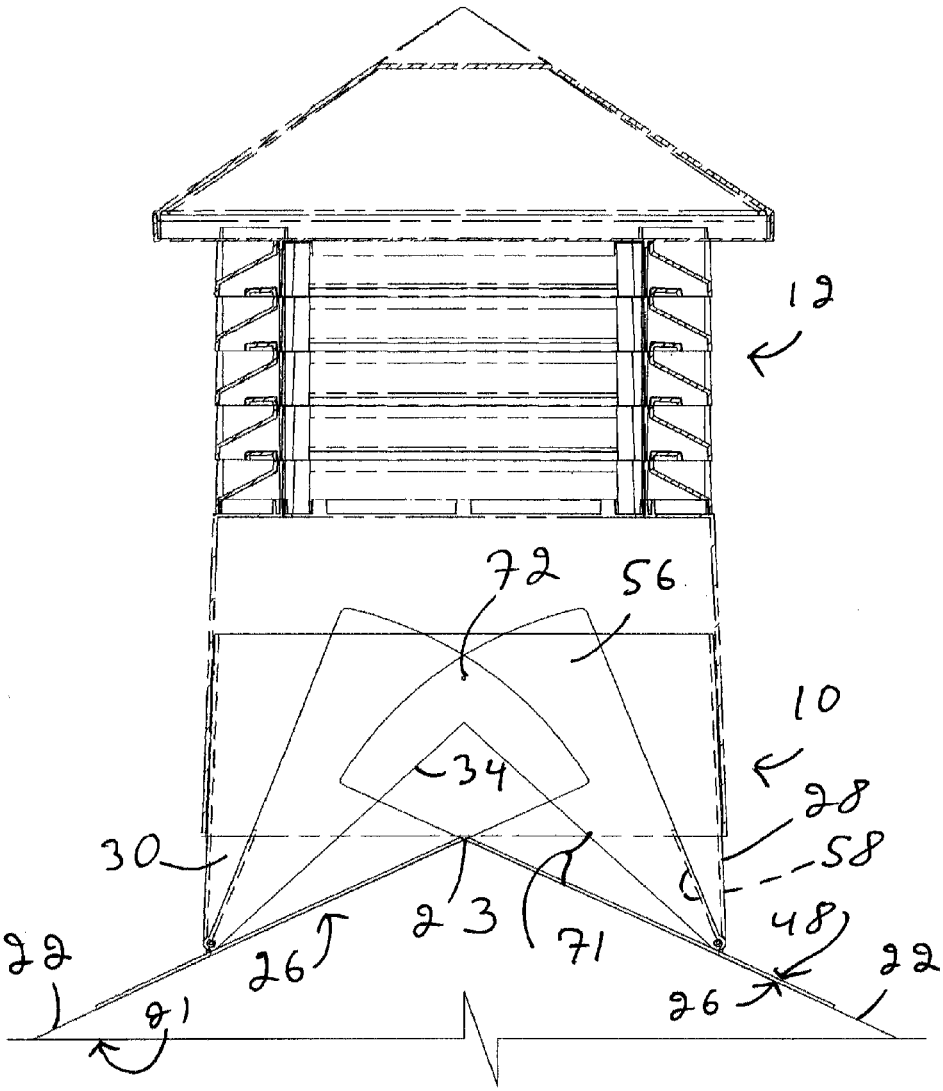
Figure 11:
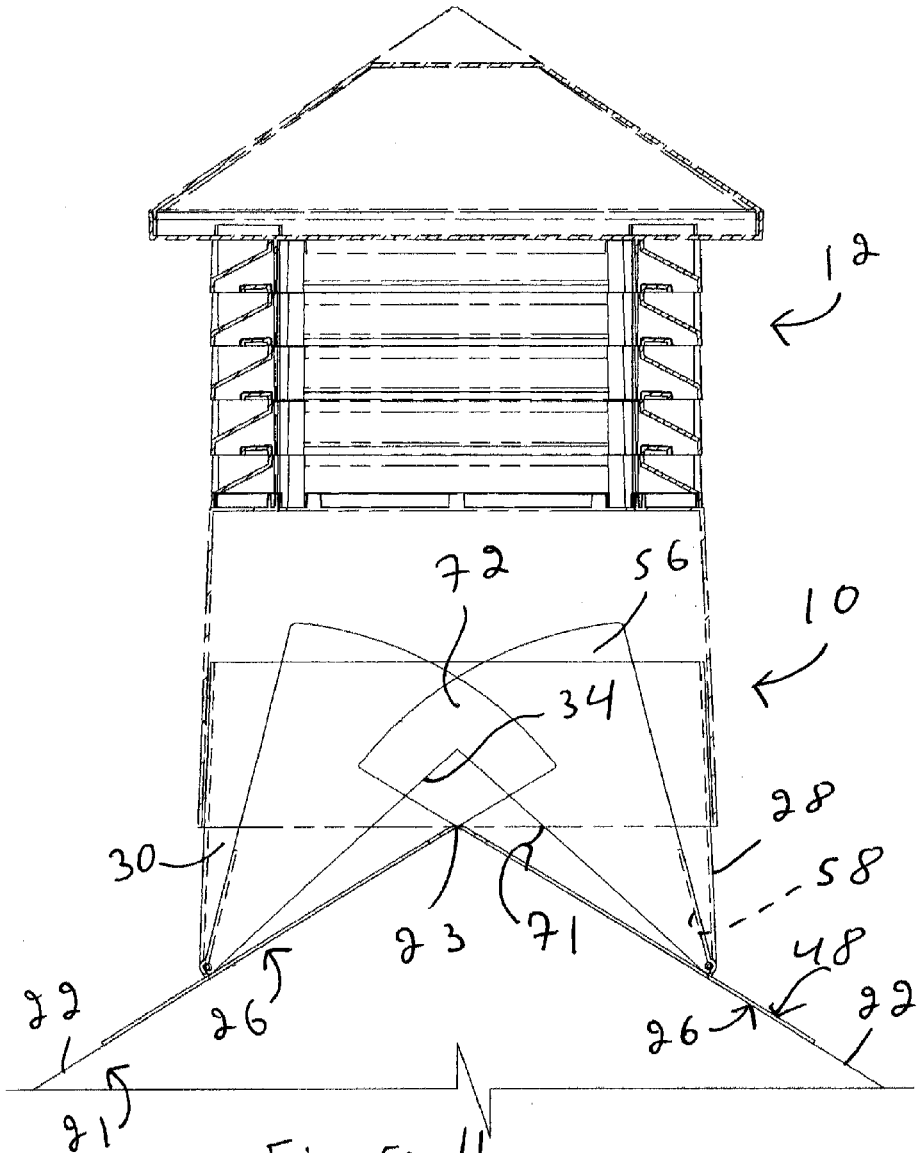
Figure 12:
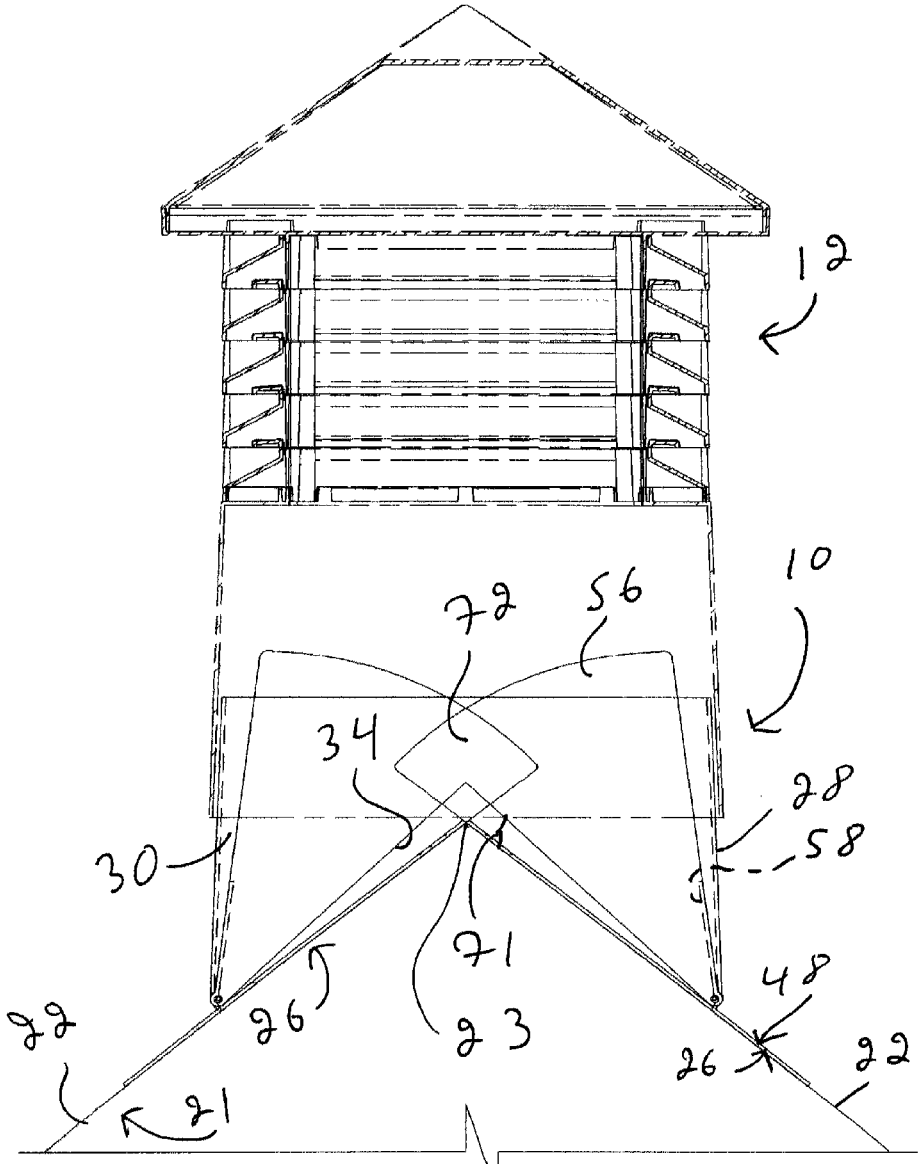
Figure 13:
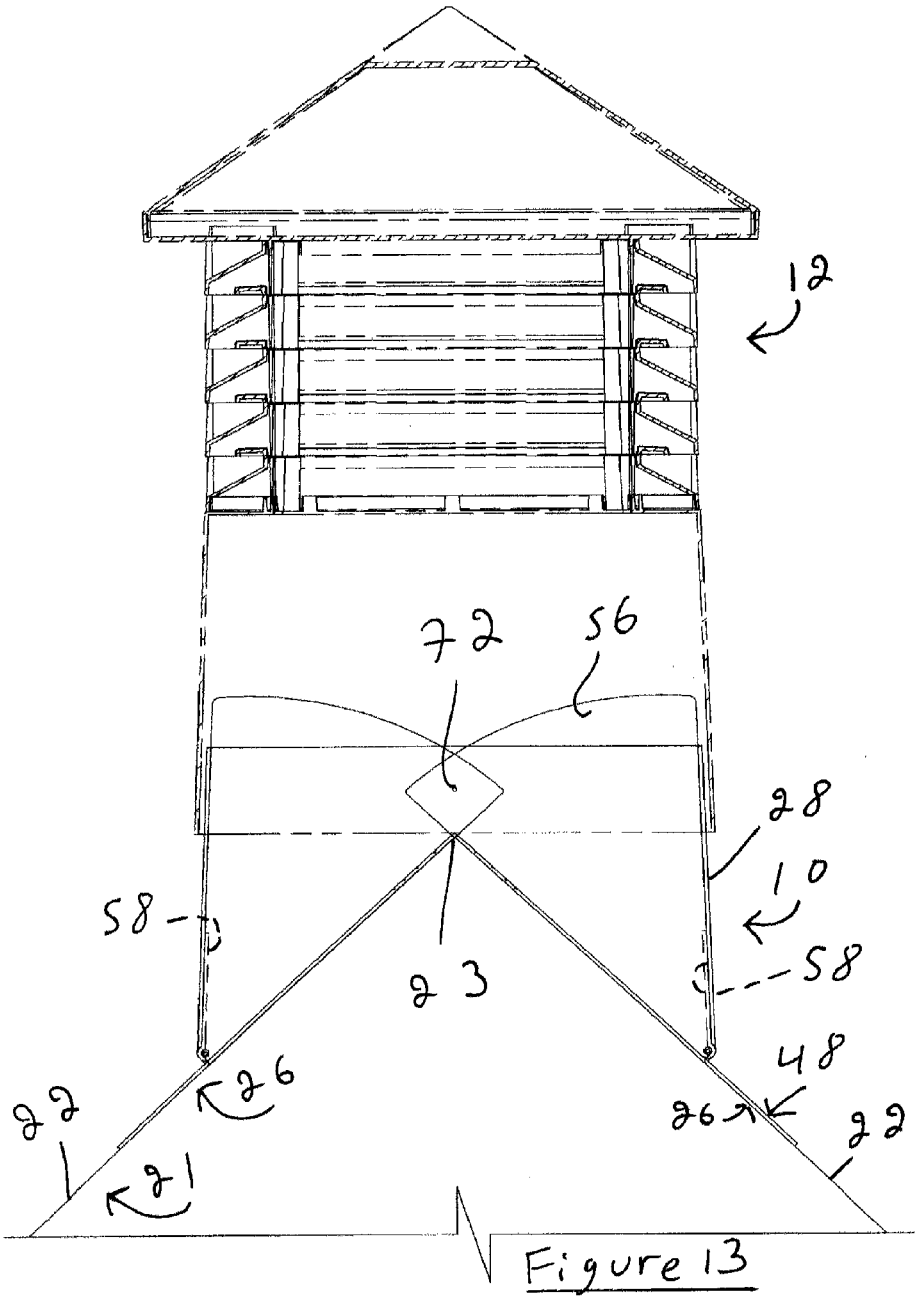

FIG. 9 illustrates a roof 21 having a relatively slight slant, while FIG. 13 illustrates a roof 21 having a relatively hard pitch. FIGS. 10 through 13 illustrate roofs 21 having gradually increasing pitches. It should be understood that the angular, or pitch, values of the roofs 21 illustrated in FIGS. 9 through 13 are only chosen by way of example and that another roof ventilator base 10 could be used with roofs 21 having other angular or pitch values without departing from the scope of the present invention.

Figure 2:
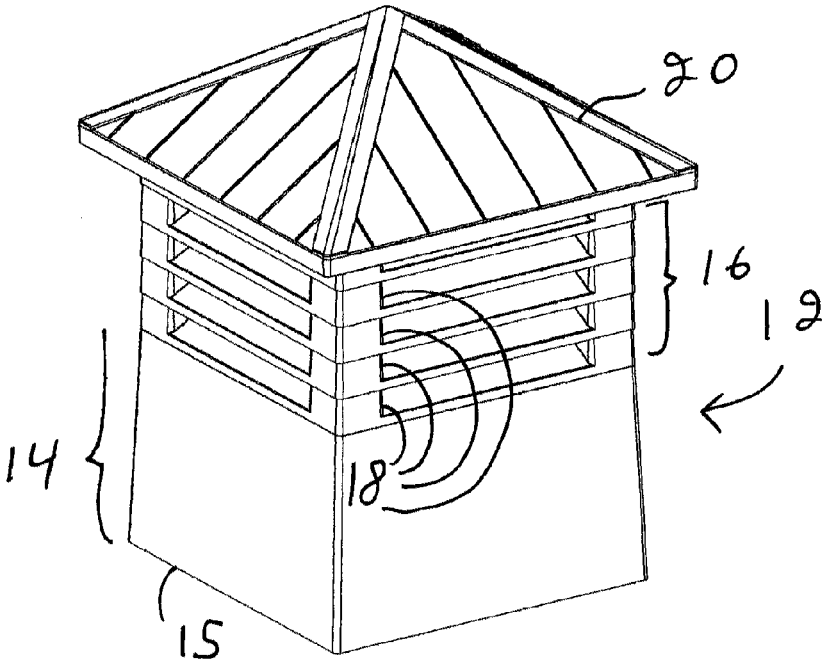
FIG. 2: in a partially exploded view, illustrates the adjustable roof ventilator base as shown in FIG. 1 with the cupola, also shown in FIG. 1, about to be mounted thereon.
Figure 2:
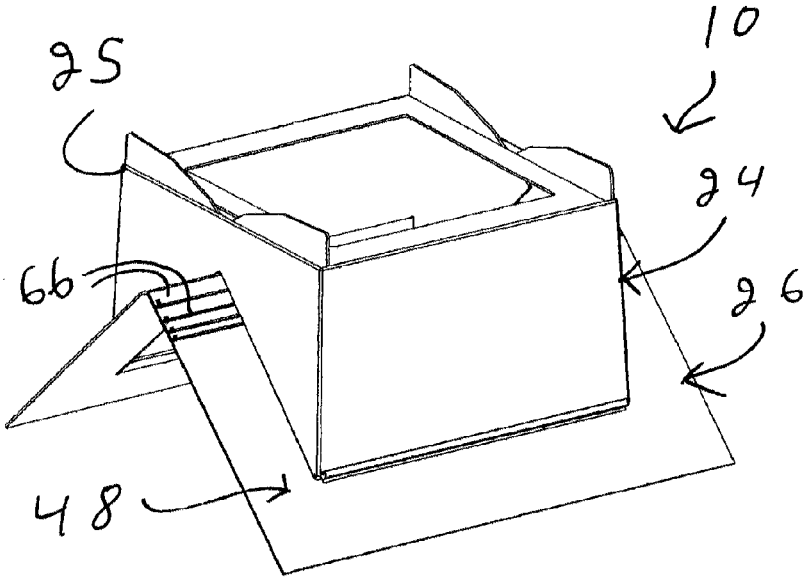
Figure 3:
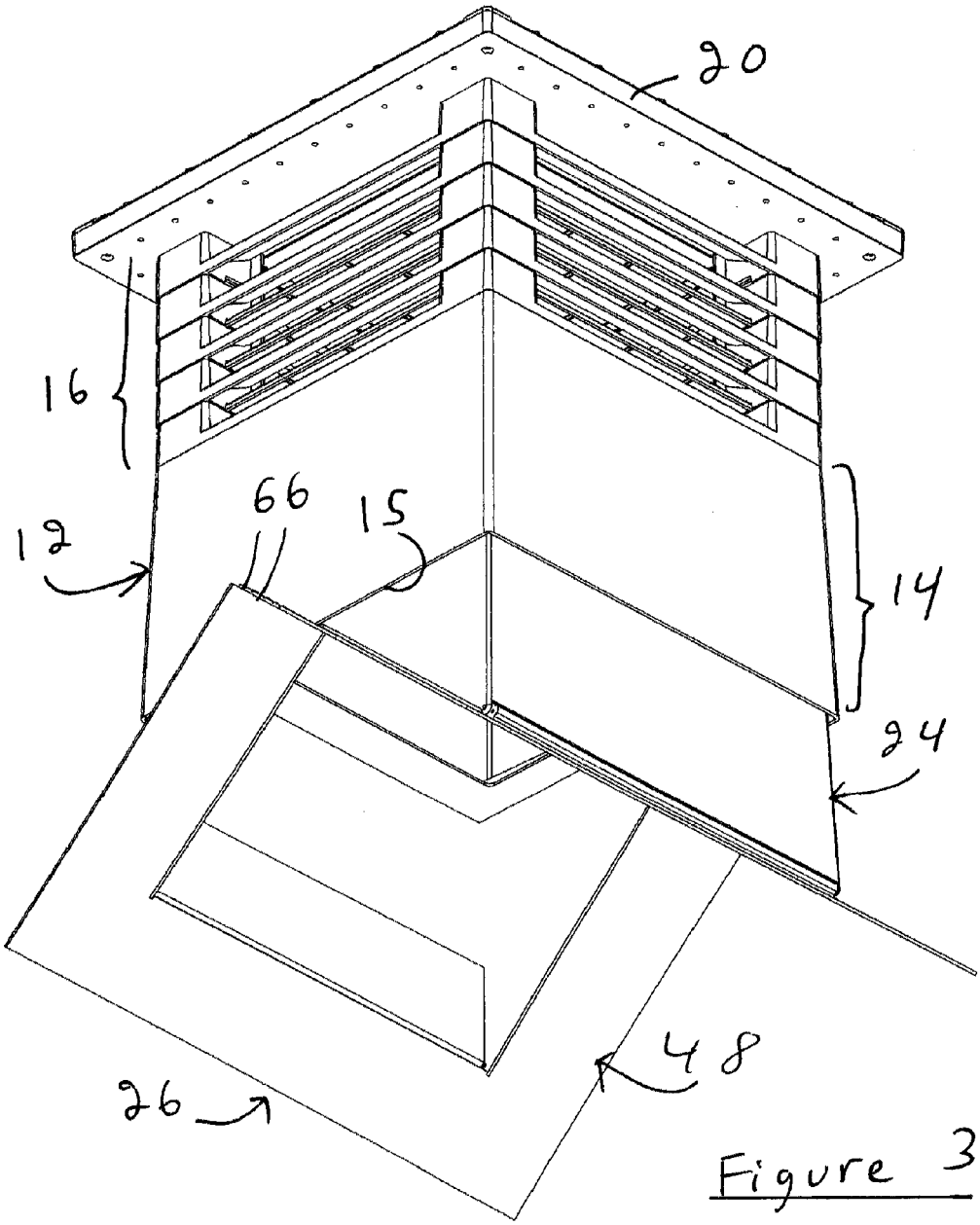
FIG. 3: in a bottom perspective view, illustrates the combination adjustable roof ventilator base and cupola shown in FIG. 1.
Figure 4:
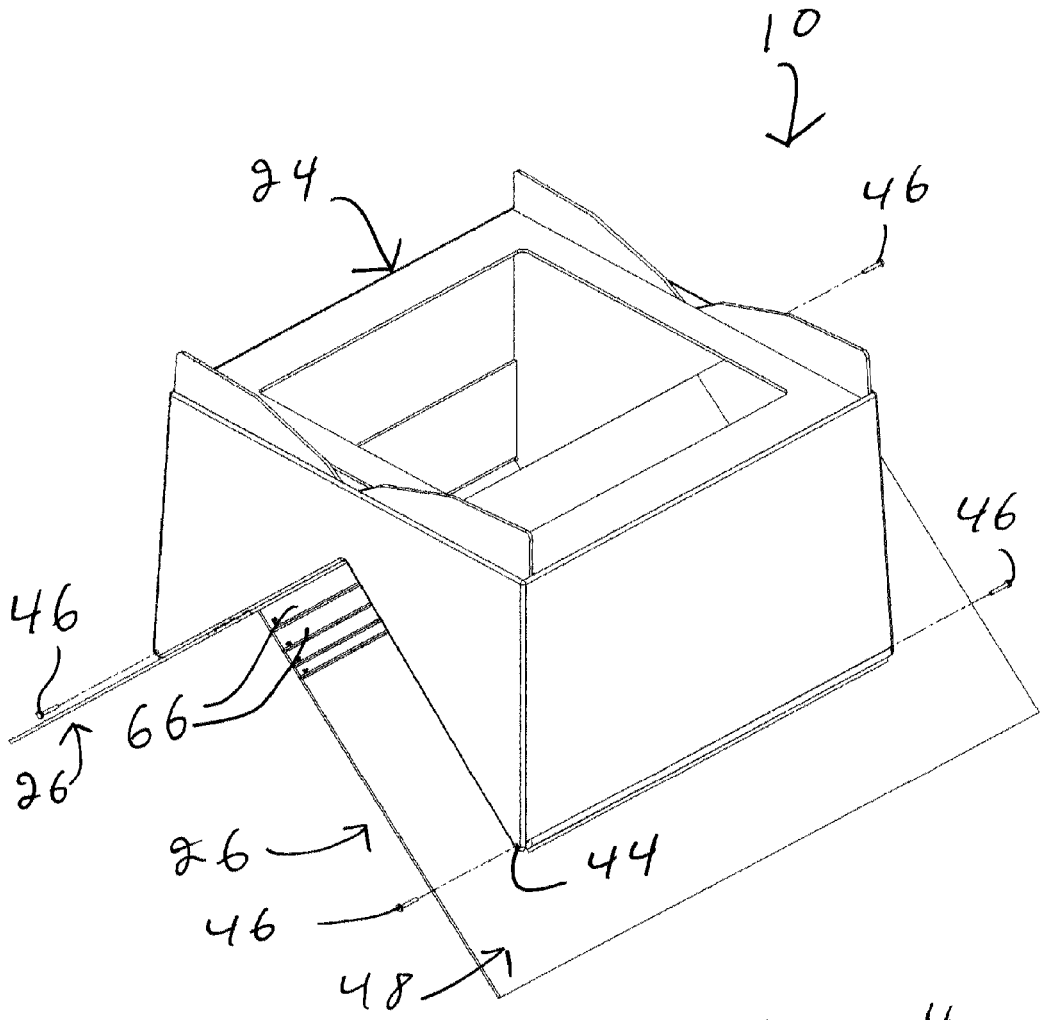
FIG. 4: in a partial perspective view, illustrates an adjustable roof ventilator base in accordance with an embodiment of the present invention.
Figure 5:
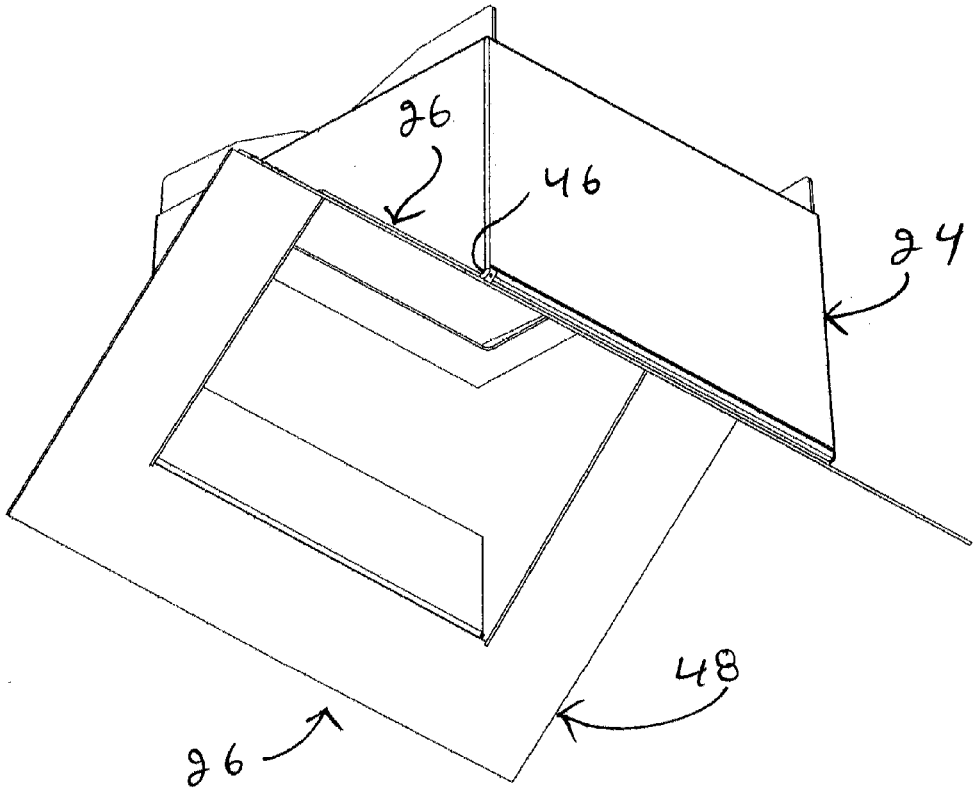
FIG. 5: in a bottom perspective view, illustrates the adjustable roof ventilator base as shown in FIG. 4.

As shown more specifically in FIGS. 2 and 4, the roof ventilator base 10 includes a supporting component 24 defining a cupola mounting portion 25 for the cupola 12 thereto. The roof ventilator base 10 also includes a pair of mounting components 26 pivotally attached the supporting component 24 for allowing mounting of the roof ventilator base 10 to roofs 21 having various pitches. The mounting components 26 form a roof ventilator mount for the roof ventilator base 10.

Figure 6:
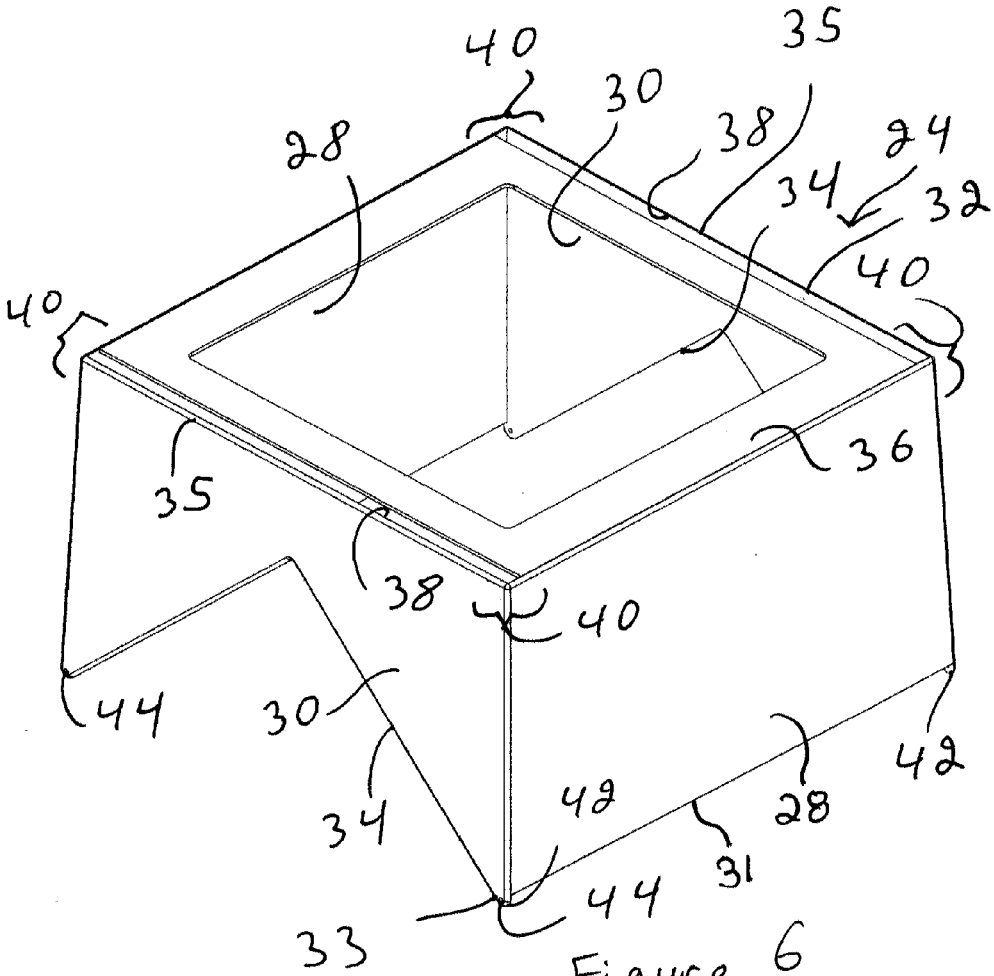
FIG. 6: in a top perspective view, illustrates a supporting component part of the adjustable roof ventilator base shown in FIGS. 1 through 5.

Referring now more specifically to FIG. 6, there is shown in greater details some of the features of the supporting component 24. The supporting component 24 includes a pair of full substantially opposed end walls 28 maintained in a substantially parallel and spaced apart relationship relative to each other by a pair of recessed lateral walls 30 extending therebetween, also extending in a substantially opposed, parallel and spaced apart relationship relative to each other so that the end and lateral walls 28 and 30 together define a substantially square or rectangular shaped supporting component upper peripheral edge 32 and a similarly shaped supporting component lower peripheral edge 31. The supporting component 24 therefore includes four corner sections 40.

The lateral walls 30 each define a lateral wall bottom edge 33 and a substantially opposed lateral wall top edge 35, a lateral wall recess 34 extending into the lateral wall bottom edges 33 of each of the lateral walls 30 substantially towards their respective lateral wall top edge 35. Typically, the lateral walls 30 are each provided with a substantially inverted V-shaped lateral wall recess 34. The lateral wall recess 34 is configured and sized so as to accommodate the roof sections 22 of a gable roof 21 having a relatively steep pitch, such as shown in FIG. 13.

The supporting component 24 is also provided with a supporting component inner flange 36 extending inwardly therefrom adjacent to the upper peripheral edge 32 thereof. A panel receiving slot 38 is formed between the flange 36 and each lateral wall 30. The panel receiving slot 38 is configured and sized for receiving sealing plates (not shown in FIG. 6), as will be hereinafter disclosed in greater details.

Each corner section 40, is provided adjacent to the supporting component lower peripheral edge 31 with a hinge means for hingedly connecting to the mounting components 26, as will hereinafter be disclosed in greater details. In the embodiment shown throughout the Figures, the hinge means includes a hinge protrusion 42 provided with the hinge aperture 44 for receiving a corresponding hinge pin 46, such as shown in FIG. 4. Therefore, the mounting components 26 are each attached to the supporting component 24 substantially adjacent a respective one of the end walls 28. Typically, the mounting components 26 are each pivotally mounted to the roof ventilator base 10 so as to be pivotable respectively about a first pivot axis and a second pivot axis, the first and second pivot axes being substantially parallel to each other.

Figure 7:
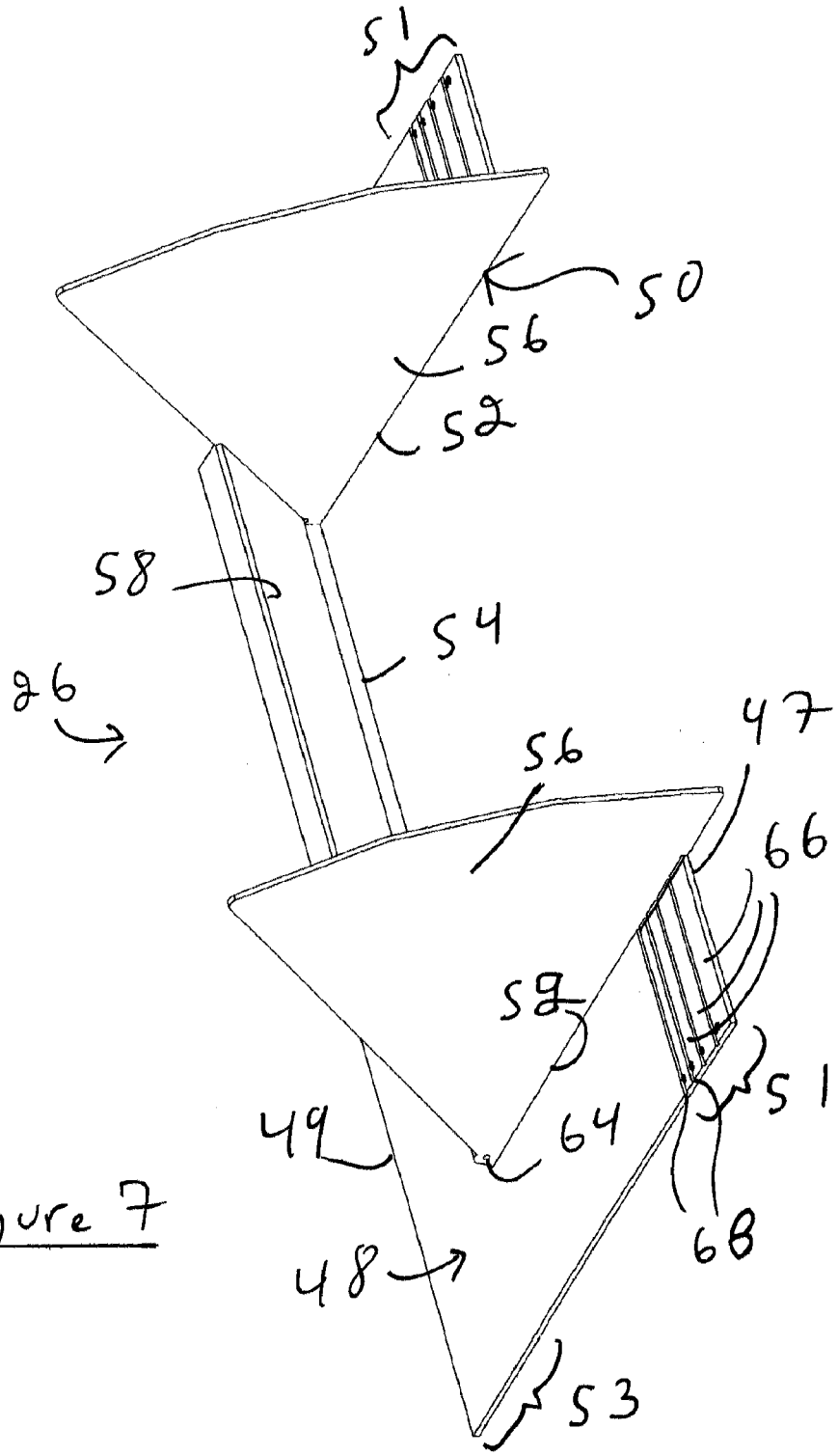
FIG. 7: in a perspective view, illustrates a mounting component part of the adjustable roof ventilator base shown in FIGS. 1 through 5.

Referring now more specifically to FIG. 7, there is shown in greater details, some of the features of the mounting components 26 (only one of which is shown in FIG. 7). Each mounting component 26 includes a mounting plate 48 mountable to a corresponding roof section 22 by abuttingly contacting the corresponding roof section 22, such as shown in FIGS. 9 through 13. Each mounting plate 48 defines a plate proximal edge 47 and a substantially opposed plate distal edge 49. Each mounting plate 48 also defines a plate proximal section 51 extending from the plate proximal edge 47 and a plate distal section 53 extending from the plate distal edge 49.

Each mounting plate 48 is provided with a corresponding mounting plate recess 50 for receiving a corresponding section of the roof ventilator base 10, and more specifically of the supporting component 24. Each mounting plate recess 50 defines a pair of substantially opposed recess lateral edges 52 each extending from the plate proximal edge 47" substantially towards the plate distal edge 49 and a recess spacing edge 54 extending therebetween substantially opposed to the plate proximal edge 47. Typically, the mounting plate 48 is substantially U-shaped.

A sealing plate 56 extends substantially away from the mounting plate 48 substantially adjacent at least one of the recess lateral edges 52. Typically, a sealing plate 56 extends substantially perpendicularly from the mounting plate 48 substantially along each of the recess lateral edges 52. Each sealing plate 56 typically has the general configuration of a sector of a circle. It should however be understood that the sealing plates 56 could have other configurations without departing from the scope of the present invention. Typically, a reinforcement plate 58 also extends between the sealing plates 56 substantially adjacent and substantially along the recess spacing edge 54.

The sealing plates 56 are provided with corresponding hinge apertures 64. The hinge apertures 64 are adapted to be put in register with the hinge apertures 44 for allowing insertion of the hinge pins 46 thereto so as to pivotally attach the mounting components 26 to the supporting component 24 for pivotal movement between an uppermost position, illustrated in FIG. 13 wherein the reinforcement plate 58 abuts against the inner surface of an adjacent end wall 28 and a lowermost position, illustrated in FIG. 9 wherein the reinforcement plate 58 is spaced from the inner surface of the adjacent end wall 28.

The plate proximal section 51 of the mounting plate 48 is provided with at least one, and typically a series of, breakable segments 66. A first one of the breakable segments 66 extends from the plate proximal edge 47. The other breakable segments 66 extend from each other. The breakable segments 66 are each breakable from the remainder of the mounting plate 48 along a predetermined break line located at a predetermined distance from the plate distal edge.

Since the mounting components 26 are mounted to the roof ventilator base with the plate proximal edges 47 located substantially adjacent to each other and the plate distal edges 49 located spaced apart from each other, removing breakable segments 66 from the plate proximal sections 51 of each mounting component 26 reduces a distance between the plate proximal and distal edges 47 and 49 of each of the mounting plates 48 to allow a variation in an angle between the two mounting plates 48 when the two mounting plates 48 are mounted to the roof ventilator base 10 with the plate proximal edges 47 of the two mounting plates 48 abutting against each other.

Figure 8:
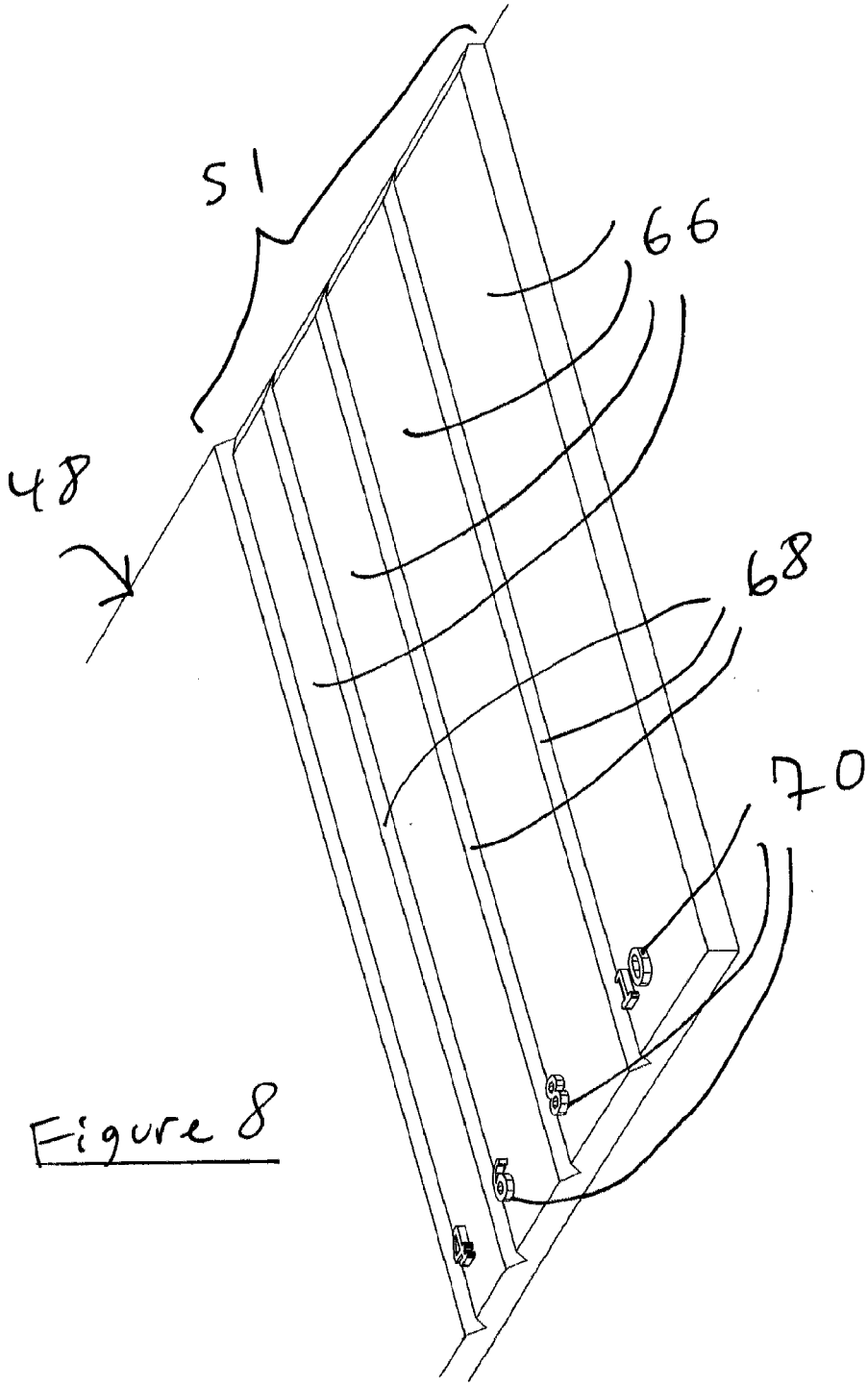
FIG. 8: in a close up detailed view, illustrates part of the mounting component shown in FIG. 7.

As illustrated more specifically in FIG. 8, the breakable segments 66 are preferably separated from each other by separation grooves 68, each separation groove extending along a respective one of the break lines separating the breakable segments 66. The separation grooves 68 typically have a substantially V-shaped or otherwise shaped configuration adapted to facilitate separation of the breakable segments 66 by a simple action, such as bending thereof about the separation grooves 68. The breakable segments 66 are adapted to facilitate adjustment of the length of the mounting plates 48 depending on the pitch or slope of the roof sections 22.

For example, in situations wherein the slope is relatively weak or small, such as shown in FIG. 9, the mounting plates 48 need to be relatively short in order to merge adjacent to the roof apex 23, whereas in situations such as shown in FIG. 13, wherein the slope is high, the mounting plates 48 need to remain at full length. Indicia 70 typically indicating conventional roof slopes are marked on the breakable segments 66 so as to facilitate customization of the size of the mounting plates 48, depending on the roof pitch prior to installation of the roof ventilator base 10 thereon.

Typically, the breakable segments 66 are each substantially rectangular and substantially planar. However, other configurations are also within the scope of the invention.

As illustrated in FIGS. 9 through 13, the pivotal movement between the supporting and mounting components 24 and 26 allows the roof ventilator base 10 to be mounted on roofs 21 of various slopes. In order to maintain a substantially air-tight seal, the sealing plates 56 are adapted to fill the gap 71 between the edges of the recess 34 and the upper surface of the sealing plates 56 depending on the pitch of the roof 21.

For example, the sealing plates 56 are practically useless with a roof such as shown in FIG. 13, whereas sealing plates 56 fill a considerable gap 71 when the slope is smaller, such as shown in FIG. 9. The angular adjustment between the mounting and supporting components 26 and 24 maybe fixed using a screw, a rivet or the like, extending through corresponding setting apertures 72 formed in the sealing plates 56 and the lateral walls 30. The distal edge of the sealing plates 56 is adapted to extend through the slot 38, such as shown in FIG. 4.

Although the present invention has been described hereinabove by way of preferred embodiments thereof, it can be modified, without departing from the spirit and nature of the subject invention as defined in the appended claims.

What is claimed is:

1. A roof ventilator mount for mounting a roof ventilator onto a gable-type roof, said gable-type roof defining a roof first section and a roof second section, said roof first and second sections merging together about a roof apex, said roof ventilator including a roof ventilator base defining a cupola mounting portion for mounting a cupola thereto, said roof ventilator mount comprising:

a first mounting component, said first mounting component including a first mounting plate mountable to said roof first section, said first mounting plate defining a first plate proximal edge and a substantially opposed first plate distal edge, said first mounting plate also defining a first plate proximal section extending from said first plate proximal edge and a first plate distal section extending from said first plate distal edge;

a second mounting component, said second mounting component including a second mounting plate mountable to said roof second section, said second mounting plate defining a second plate proximal edge and a substantially opposed second plate distal edge, said second mounting plate also defining a second plate proximal section extending from said second plate proximal edge and a second plate distal section extending from said second plate distal edge;

said first and second mounting components being mountable to said roof ventilator base with said first and second plate proximal edges located substantially adjacent to each other and said first and second plate distal edges located spaced apart from each other;

said first plate proximal section being provided with a first plate breakable segment extending from said first plate proximal edge, said first plate breakable segment being breakable from the remainder of said first plate proximal section along a first predetermined break line located at a first predetermined distance from said first plate distal edge;

said second plate proximal section being provided with a second plate breakable segment extending from said second plate proximal edge, said second plate breakable segment being breakable from the remainder of said second plate proximal section along a second predetermined break line located at a second predetermined distance from said second plate distal edge;

whereby removing said first and second plate breakable segments respectively from said first and second plate proximal sections reduces respectively a first distance between said first plate proximal and distal edges and a second distance between said second plate proximal and distal edges to allow a variation in an angle between said first and second mounting plates when said first and second mounting plates are mounted to said roof ventilator base and said first and second plate proximal edges are abutting against each other.

2. A roof ventilator mount as defined in claim 1, wherein said first plate breakable segment is a first plate first breakable segment;

said first predetermined break line is a first plate first predetermined break line; and said first plate proximal section is provided with a first plate second breakable segment extending from said first plate first breakable segment substantially opposed to said first plate proximal edge, said first plate second breakable segment being breakable from the remainder of said first plate proximal section along a first plate second predetermined break line located at a third predetermined distance from said first plate distal edge, said first plate second predetermined break line being located between said first plate distal edge and said first plate first predetermined break line.

3. A roof ventilator mount as defined in claim 1, wherein said first plate breakable segment is substantially planar.

4. A roof ventilator mount as defined in claim 1, wherein said first plate breakable segment is substantially rectangular.

5. A roof ventilator mount as defined in claim 1, wherein said first and second mounting plates are each pivotally mountable to said roof ventilator base so as to be pivotable respectively about a first pivot axis and a second pivot axis.

6. A roof ventilator mount as defined in claim 5, wherein said first and second pivot axes are substantially parallel to each other.

7. A roof ventilator mount as defined in claim 1, wherein said first mounting plate defines a first mounting plate recess for receiving a corresponding section of said roof ventilator base.

8. A roof ventilator mount as defined in claim 7, wherein said first mounting plate recess defining a pair of substantially opposed recess lateral edges each extending from said first plate proximal edge substantially towards said first plate distal edge and a recess spacing edge extending therebetween said lateral edges substantially opposed to said first plate proximal edge.

9. A roof ventilator mount as defined in claim 8, wherein said first mounting plate is substantially U-shaped.

10. A roof ventilator mount as defined in claim 8, wherein said first mounting component includes a sealing plate extending substantially away from said first mounting plate substantially adjacent one of said recess lateral edges.

11. A roof ventilator as defined in claim 10, wherein said sealing plate extends substantially perpendicularly to said first mounting plate.

12. A roof ventilator as defined in claim 10, wherein said sealing plate has a general configuration of a sector of a circle.

13. A roof ventilator as defined in claim 8, wherein said first mounting component includes a pair of sealing plates each extending substantially away from said first mounting plate substantially along a respective one of said recess lateral edges; and a reinforcement plate extending between said sealing plates substantially adjacent said recess spacing edge.

14. A roof ventilator as defined in claim 1, wherein said first mounting plate defines a groove separating said first plate breakable segment from said remainder of said first mounting plate.

15. A roof ventilator as defined in claim 14, wherein said groove has a substantially V-shaped transversal cross-sectional configuration.

16. A roof ventilator as defined in claim 1, wherein an indicia indicative of a conventional roof slope is marked on said breakable segment.

17. A roof ventilator base for mounting a roof ventilator including a cupola onto a gable-type roof, said gable-type roof defining a roof first section and a roof second section, said roof first and second sections merging together about a roof apex, said roof ventilator base comprising:

a supporting component, said supporting component defining a cupola mounting portion for mounting said cupola thereto;

a first mounting component, said first mounting component including a first mounting plate mountable to said roof first section, said first mounting plate defining a first plate proximal edge and a substantially opposed first plate distal edge, said first mounting plate also defining a first plate proximal section extending from said first plate proximal edge and a first plate distal section extending from said first plate distal edge;

a second mounting component, said second mounting component including a second mounting plate mountable to said roof second section, said second mounting plate defining a second plate proximal edge and a substantially opposed second plate distal edge, said second mounting plate also defining a second plate proximal section extending from said second plate proximal edge and a second plate distal section extending from said second plate distal edge;

said first and second mounting components being mounted to said supporting component with said first and second plate proximal edges positionable substantially adjacent to each other and said first and second plate distal edges located spaced apart from each other;

said first plate proximal section being provided with a first plate breakable segment extending from said first plate proximal edge, said first plate breakable segment being breakable from the remainder of said first plate proximal section along a first predetermined break line located at a first predetermined distance from said first plate distal edge;

said second plate proximal section being provided with a second plate breakable segment extending from said second plate proximal edge, said second plate breakable segment being breakable from the remainder of said second plate proximal section along a second predetermined break line located at a second predetermined distance from said second plate distal edge;

whereby removing said first and second plate breakable segments respectively from said first and second plate proximal sections reduces respectively a first distance between said first plate proximal and distal edges and a second distance between said second plate proximal and distal edges to allow a variation in an angle between said first and second mounting plates when said first and second plate proximal edges are abutting against each other.

18. A roof ventilator base as defined in claim 17, wherein said supporting component defines a pair of substantially opposed end walls and a pair of substantially opposed lateral walls extending therebetween, said first and second mounting components being each attached to said supporting component substantially adjacent a respective one of said end walls.

19. A roof ventilator base as defined in claim 18, wherein said lateral walls each define a lateral wall bottom edge and a substantially opposed lateral wall top edge, at least one of said lateral walls defining a lateral wall recess extending into said lateral wall bottom edge substantially towards said lateral wall top edge.

20. A roof ventilator base as defined in claim 19, wherein said first mounting plate defines a first mounting plate recess for receiving a corresponding section of said base, said first mounting plate recess defining a pair of substantially opposed recess lateral edges each extending from said first plate proximal edge substantially towards said first plate distal edge and a recess spacing edge extending therebetween substantially opposed to said first plate proximal edge, said first mounting component including a sealing plate extending substantially away from said first mounting plate substantially adjacent one of said recess lateral edges and substantially in register with said lateral wall recess.

* * * * *